US006384545B1

(12) United States Patent
Lau

(10) Patent No.: US 6,384,545 B1
(45) Date of Patent: May 7, 2002

(54) LIGHTING CONTROLLER

(76) Inventor: Ee Theow Lau, 2C Kovan Road, Singapore (SG)

( * ) Notice: Subject to any disclaimer, the term of this patent is extended or adjusted under 35 U.S.C. 154(b) by 0 days.

(21) Appl. No.: 09/811,984

(22) Filed: Mar. 19, 2001

(51) Int. Cl.[7] ..... G05F 1/00
(52) U.S. Cl. ..... 315/292; 315/297
(58) Field of Search ..... 315/297, 291, 315/292, 293, 294, 307, 312, 314, 210, 209 R, DIG. 4, DIG. 7

(56) References Cited

U.S. PATENT DOCUMENTS 4,125,781 A 11/1978 Davis, Jr. ..... 307/11
4,215,277 A * 7/1980 Weiner et al. ..... 307/41
4,253,045 A * 2/1981 Weber ..... 315/210
4,678,926 A 7/1987 Davis ..... 307/11
4,890,000 A 12/1989 Chou ..... 307/36
5,128,595 A * 7/1992 Hara ..... 315/312
5,300,864 A * 4/1994 Allen, Jr. ..... 315/314
5,629,587 A * 5/1997 Gray et al. ..... 315/292
6,285,140 B1 * 9/2001 Ruxton ..... 315/312

* cited by examiner

*Primary Examiner*—Don Wong
*Assistant Examiner*—Chuc D Tran
(74) *Attorney, Agent, or Firm*—Conley, Rose & Tayon, P.C.

(57) ABSTRACT

A lighting controller for performing lighting control operations of decorative lighting elements is disclosed. The controller comprises a processor and an electricity supply connector to which a lighting element is connectable. The controller also comprises a switching device for delivering electricity supply to a lighting element connected to the electricity supply connector. The processor calculates the timing and duration for modulating the lighting element brightness and accordingly actuates the switching device to deliver electricity supply to the lighting element.

10 Claims, 8 Drawing Sheets

LIGHTING CONTROLLER

FIELD OF INVENTION

The invention relates generally to the control of lights. In particular, the invention relates to the control of strings of lighting elements to provide multiple lighting effects and sequence lighting patterns.

BACKGROUND

A number of U.S. patents disclose the conventional control of switching and brightness of decorative or display lighting sets using lighting controllers. In low-end implementations, a lighting controller either works in a stand-alone mode or is connected to a computer so that a user may change the sequence of switching and brightness of lighting elements. These lighting controllers are thus not designed for large-scale deployment other than in situations where restricted extensions of decorative lighting occur through the use of additional powering devices. In situations where large numbers of lighting controllers are deployed, lighting operations are not synchronized because each lighting controller has an independent timing mechanism and therefore operates independently.

Conventional lighting control operations also typically involve use of various forms of logic gates or mechanical devices and resistive/capacitive pairs (RC) to generate timing to control the intensity and the duration of lighting. Thus, such lighting control operations do not involve changing profiles of brightness directly by software. The lighting control operations are disclosed in U.S. Pat. Nos. 4,890,000, 4,125,781, 4,215,277, 4,678,926, 5,300,864, and 5,629,587.

With conventional lighting control operations, there are a number of limitations. For example, in many situations involving lighting decorations, such as the decoration of plants and trees in a garden, conventional 'disco' lighting effects with flickering and flashing lights may not suit the quiet and restful environment found in a garden. Additionally, the electric current drawn by a large number of lighting elements such as light bulbs in situations requiring large-scale deployment of lighting decorations may be more than what a stand-alone lighting controller delivers.

It is therefore clear from the foregoing limitations that a different type of lighting controller is necessary.

SUMMARY

In accordance with an aspect of the invention a lighting controller for performing lighting control operations of decorative lighting elements is provided. The controller comprises a processor and an electricity supply connector to which a lighting element is connectable. The controller also comprises a switching device for delivering electricity supply to a lighting element connected to the electricity supply connector. The processor calculates the timing and duration for modulating the lighting element brightness and accordingly actuates the switching device to deliver electricity supply to the lighting element.

BRIEF DESCRIPTION OF DRAWINGS

Embodiments of the invention are described hereinafter with reference to the drawings, in which.

DETAILED DESCRIPTION

Figure 1:
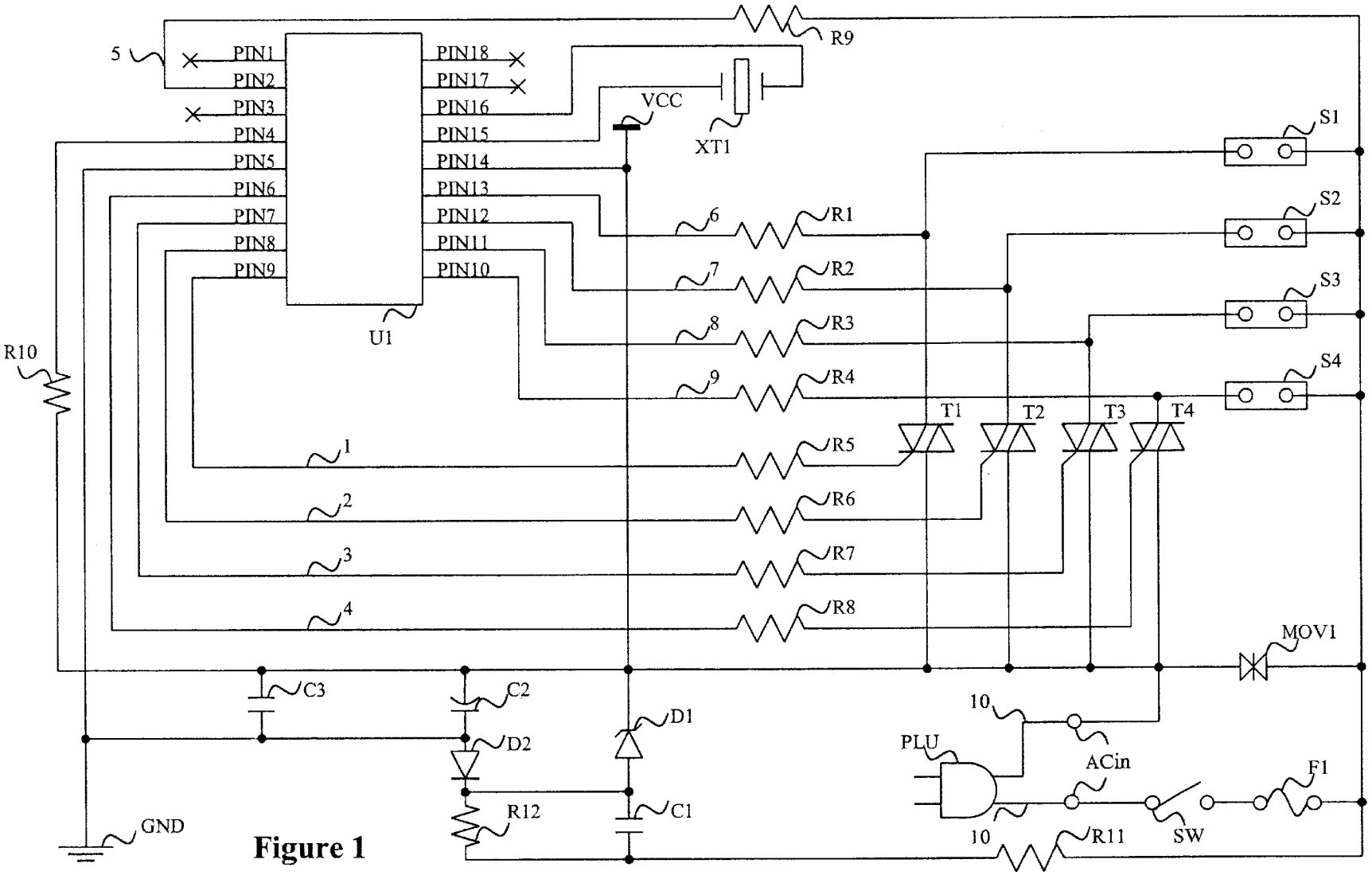
FIG. 1 illustrates a schematic diagram of a lighting controller according to a preferred embodiment of the invention.

In order to meet the foregoing needs pertaining to conventional lighting control operations, a lighting controller that produces a wide variety of lighting displays characterised by synchronous and continuous modulated brightness of strings of lighting elements is provided. During lighting control operations, the lighting controller controls delivers electrical power to strings of lighting elements using power sockets and performs brightness modulation of the strings of lighting elements through the power sockets. Through the lighting controller, the brightness of decorative strings of lighting elements may be modulated to any level —independently increasing or decreasing at any rate or stopped at any point—to produce special lighting effects such as the emulation of a fireworks display. The lighting controller may also enable a mixture of lighting colours to be produced by allowing different levels of colour intensities to be displayed for different strings of lighting elements with different lighting colours. Furthermore, the lighting controller also provides for low-rate modulation of light intensities thereby resulting in gradual transformation of lighting colours from one lighted string of lighting elements to the next lighted string of a different lighting colour.

A number of lighting controllers may interoperate to collectively act as a single entity. In such an arrangement, complicated wiring connections are not required for conveying synchronisation signals among multiple lighting controllers. Instead, group synchronisation of the lighting controllers is achieved through a common alternating-current (A/C) mains providing electricity supply from which the lighting controllers tap electricity.

A micro-controller is preferably used in the lighting controller according to embodiments of the invention, in which the modulation of light intensity of strings of lighting elements is performed by preferably using pulse signals generated directly by the micro-controller. The control logic of the lighting controller is codified in software that is executed by the micro-controller while performing lighting control operations.

In lighting control operations, the micro-controller preferably successively calculates and generates the pulse signals in every half period of an A/C cycle during the process of brightness modulation. The overall timing of the software-based lighting control operations is preferably locked onto the A/C mains frequency. Since the A/C mains frequency is essentially a non-deviating frequency which is ubiquitous to all A/C sockets connected to the A/C mains, the lighting controllers that are connected to the A/C sockets are synchronised to the A/C mains frequency thereby exhibiting similar and predictable lighting control operations, which in this case is a similar pattern of lighting.

There are manifold advantages associated with the lighting controller. A primary advantage of using the lighting controller is that the lighting controller performs lighting control operations in a stand-alone mode as well as a synchronised-group mode. In the synchronised-group mode, a number of lighting controllers may synchronise as a group and lock onto the A/C mains frequency when the lighting controllers are connected to the common A/C mains and switched-on at the same time using a mains circuit breaker. Hence, no additional connection wiring is needed for a large number of lighting controllers to operate in the synchronised-group mode.

A further advantage of using the lighting controller is that the lighting controller modulates the light intensities of strings of lighting elements through a Modulation Subroutine Module (described in greater detail hereinafter) in the software. This software module successively calculates timing values and positions of pulse signals generated by the micro-controller with substantially precise timing relative to the zero crossing timing of the A/C mains to energise triacs for delivering power to strings of lighting elements. Changes in the calculated values of the timing for generating pulse signals eventually controls the ramp-up and ramp-down of power levels delivered through each triac, resulting in the modulation of the intensity of each string of lighting elements.

Yet another advantage of using the lighting controller is that the lighting controller uses other software modules to load the various internal control parameters to the Modulation Subroutine Module to produce various brightness profiles and lighting effects in strings of lighting elements through the triacs.

A still further advantage of using the lighting controller is that the lighting controller utilises software to generate various sequencing controls to provide various sequences of lighting effects in which the sequencing controls only affect power sockets to which strings of lighting elements are connected. Hence, limited intelligence is built into the lighting controller, so that in a practical situation where a user may not want to connect a string of lighting elements to every power socket, the lighting controller performs sequencing controls only according to the number of strings of lighting elements connected. Furthermore, when a connected string of lighting elements burns out, the lighting sequences are not disrupted because another string of lighting elements takes over.

With reference to a schematic diagram shown in FIG. 1, the hardware of the lighting controller according to a preferred embodiment is described in detail. A lighting controller printed circuit board (PCB) is located in a housing with A/C wiring ACin and a power plug PLU for connection to an A/C socket (not shown) to power the lighting controller and to deliver power to strings of lighting elements connected to a number of power sockets S1 to S4. Triacs T1 to T4 are used to switch A/C electricity supply to each power socket S1, S2, S3, or S4. The number of power sockets to be implemented is dependent on the number of triacs used and corresponding software modules used in lighting control operations.

A power ON/OFF switch SW is connected in series with the A/C wiring ACin to allow a user to switch off the lighting controller when not in used. A fuse F1 is connected in series with the ON/OFF switch SW to provide short-circuit protection in the event of a short circuit in any connected string of lighting elements. An over-voltage protection device MOV1 for suppressing any spikes in the A/C electricity supply provides additional protection for the triacs T1 to T4.

A capacitor C1 is used to supply an A/C electricity supply to a Zener diode D1 with 5.6 volts rating. A 5.6 volts direct current (D/C) voltage developed across the Zener diode D1 then passes through a diode D2 and charges up a capacitor C2 to a D/C voltage of 5 volts. A 5 volts D/C supply is thus formed across the terminals of the capacitor C2, a PCB reference ground GND being connected to one of the capacitor C2 terminals, and is used to power a micro-controller U1. A capacitor C3 placed in parallel with the capacitor C2 is used for filtering the 5 volts D/C supply by decoupling any A/C noise that is generated by the micro-controller U1. A resistor R11 is used to limit the charging current passing through the capacitor C1 and a resistor R12 is used to discharge any current remaining in the capacitor C1 when the ON/OFF switch SW is open.

A crystal XT1, or any other similar resonating device such as a ceramic resonator, is connected to the micro-controller U1 for providing an oscillating frequency. The micro-controller U1 may be an embedded chip package of any form factor or bonded to the PCB. An example of a device that may be used as the micro-controller U1 is the PIC16F628 micro-controller from Microchip Technology, Inc.

Figure 2:
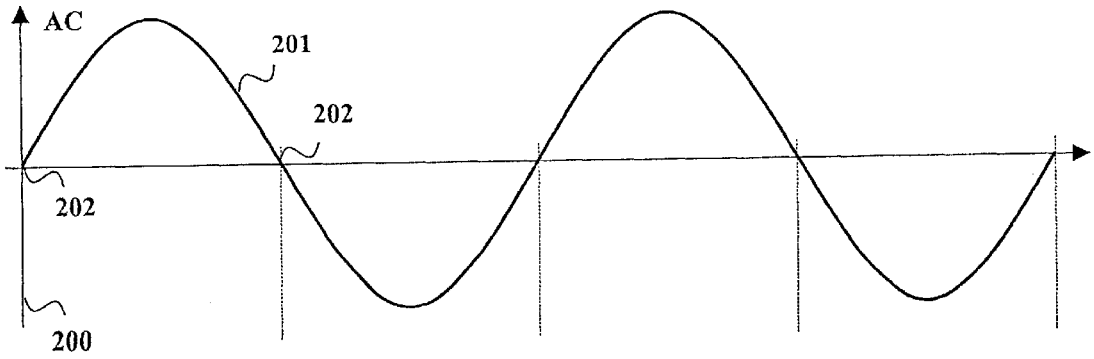
FIG. 2 illustrates the waveform of a reference alternating current (A/C) electricity supply.
Figure 3:
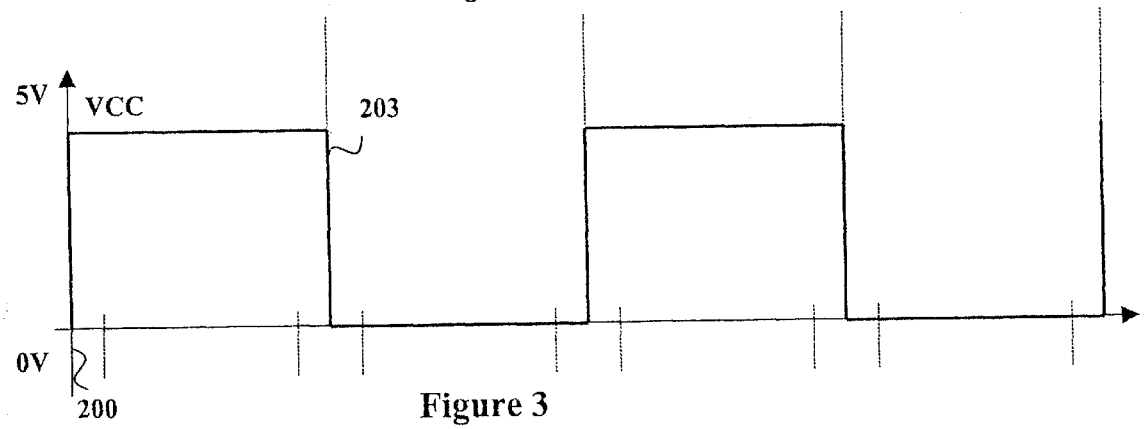
FIG. 3 illustrates the waveform of a square wave present at a reference pin of a micro-controller in FIG. 1.

A resistor R9 is connected in series with the fuse F1 and to reference pin PIN2 of the micro-controller U1 to convert the A/C electricity supply (50 Hertz or 60 Hertz) 201 as shown in FIG. 2 into a square wave 203 as shown in FIG. 3. Each time the A/C electricity supply reaches a zero crossing point 202, the square wave 203 changes voltage levels so that the micro-controller U1 may take reference from a leading edge 200 of each cycle of the A/C electricity supply. The substantially high resistance of resistor R9 of several mega-ohms prevents excessive current from the A/C electricity supply 201 from damaging the micro-controller U1. A pull-up resistor R10 connected between a reset pin PIN4 of the micro-controller U1 and the 5 volt supply and is used to drive the reset pin PIN4.

Resistors R1, R2, R3, R4 are connected to detect pins PIN13, PIN12, PIN11, and PIN10, respectively, of the micro-controller U1 to detect the presence of any string of lighting element, such as a string of decorative light bulbs, connected to any power socket S1, S2, S3, or S4, respectively. A signal 6, 7, 8 or 9 bearing the same waveform as the square wave 203 may be present at any detect pin PIN13, PIN12, PIN11, or PIN10, thereby indicating that a string of lighting elements is connected to the corresponding power socket S1, S2, S3, or S4. In relation to any power socket S1, S2, S3, or S4 to which a string of lighting elements is not connected, the corresponding pin PIN13, PIN12, PIN11, or PIN10 remains floating with reference to the micro-controller U1 ground pin PIN5, which is connected to the PCB reference ground GND. A software module processes the signals 6, 7, 8 or 9 to detect the presence or absence of a string of lighting elements at any power socket S1, S2, S3, or S4.

Figure 4:
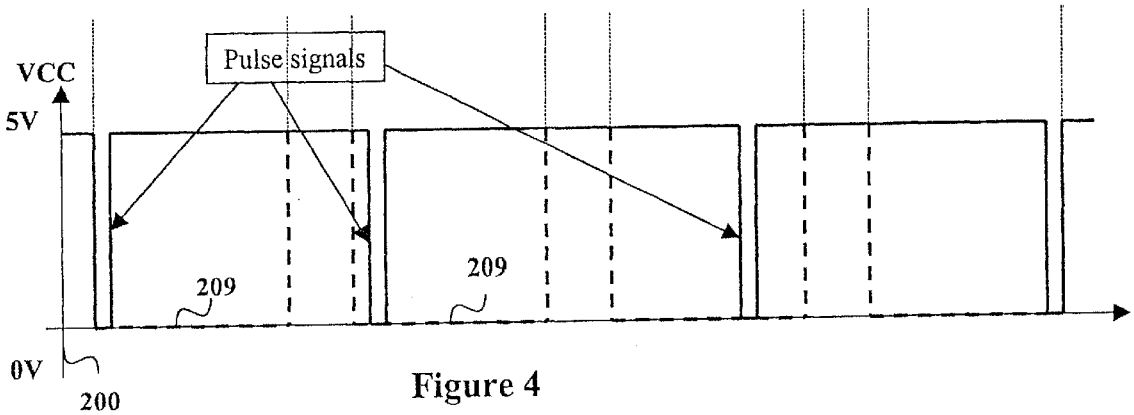
FIG. 4 illustrates a the waveform of a pulse signal generated at a pulse pin of the micro-controller in FIG. 1.

Pulse signals 1, 2, 3 and 4, as shown in FIG. 4, are provided by pulse pins PIN9, PIN8, PIN7, and PIN6, respectively, and sent through respective series resistors R5, R6, R7 and R8 to trigger or actuate the triacs T1, T2, T3, and T4, respectively, to turn on and deliver the A/C electricity supply 201 to the respective power sockets S1, S2, S3, or S4. The triacs T1 , T2, T3, and T4 turn off once the A/C electricity supply 201 reaches the next zero crossing point therefore cutting off the A/C electricity supply 201 to the power sockets S1, S2, S3, or S4. The pulse signals 1, 2, 3 and 4 may be generated at any time within window periods 209 as shown in FIG. 4. If a pulse signal 1, 2, 3, or 4 is generated at the beginning of a window period 209, the respective triac T1 , T2, T3, or T4 is turned on early in the window period 209 and therefore the light intensity of the respectively connected string of lighting elements is at the highest. Conversely, if a pulse signal 1, 2, 3, or 4 is generated at near the end of a window period 209, the light intensity of the respective connected string of lighting elements is at the lowest.

The software codifying the control logic for the lighting controller is a multi-process program. Hence, most of the codes are preferably reused for different processes of similar nature. For efficacy reasons, the description provided hereinafter with reference to FIGS. 5 to 10 thus only provides details of processes of different nature. Cross- or multi-process manipulations are also highlighted to show how different processes interact.

Figure 5:
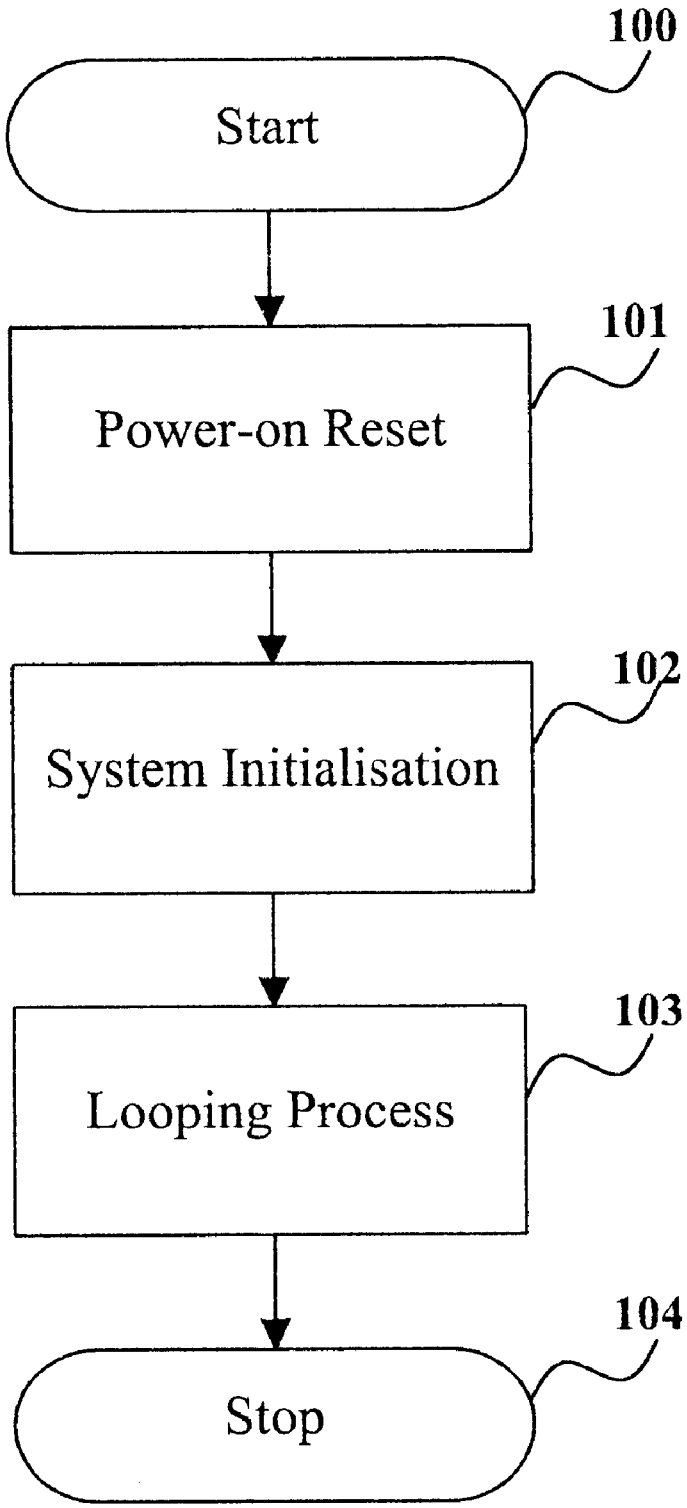
FIG. 5 is a Software System Overview flowchart.

With reference to FIG. 5, the lighting controller, hereinafter referred to generally as the system, starts lighting control operations in process 100 upon power on. All hardware and software system resources are reset in a process 101 to a fix value. The system initialises in a process 102 all micro-controller U1 resources, for example Reset Vectors, Interrupt Service Routine Vectors, and etc., to begin program execution. After which, the program runs by looping infinitely in a process 103 until the power is switch off, where the system terminates lighting control operations immediately in a process 104.

The program execution is explained in terms of processes hereinafter and all different processes are mutually exclusive in terms of system resources, for example, memory locations and registers, and time of execution. There are four main variables in the program, namely Pulse Position, Pulse Position Counter, Ramp Rate and Ramp Value with Sign Bit. These variables are private, in terms of uniqueness, to corresponding processes. In the system with N number of processes, there are N sets of such variables, each set having values unique to corresponding processes. This allows independent control of light modulation of each string of lighting elements connected to each corresponding power socket S1, S2, S3, or S4. Hence, the program may be scaled to include more processes to control additional triacs to deliver electricity supply to additional power sockets.

When the term 'program' is used herein, the term refers to all the various processes as one entity. Similarly, when the term 'module' is used, the term refers to the conceptual embodiment of a process.

The looping process 103 is described hereinafter to explain how the program through the different processes interacts with the hardware in the system to produce the electrical effects resulting in the generation of pulse signals shown in FIG. 4.

Figure 9:
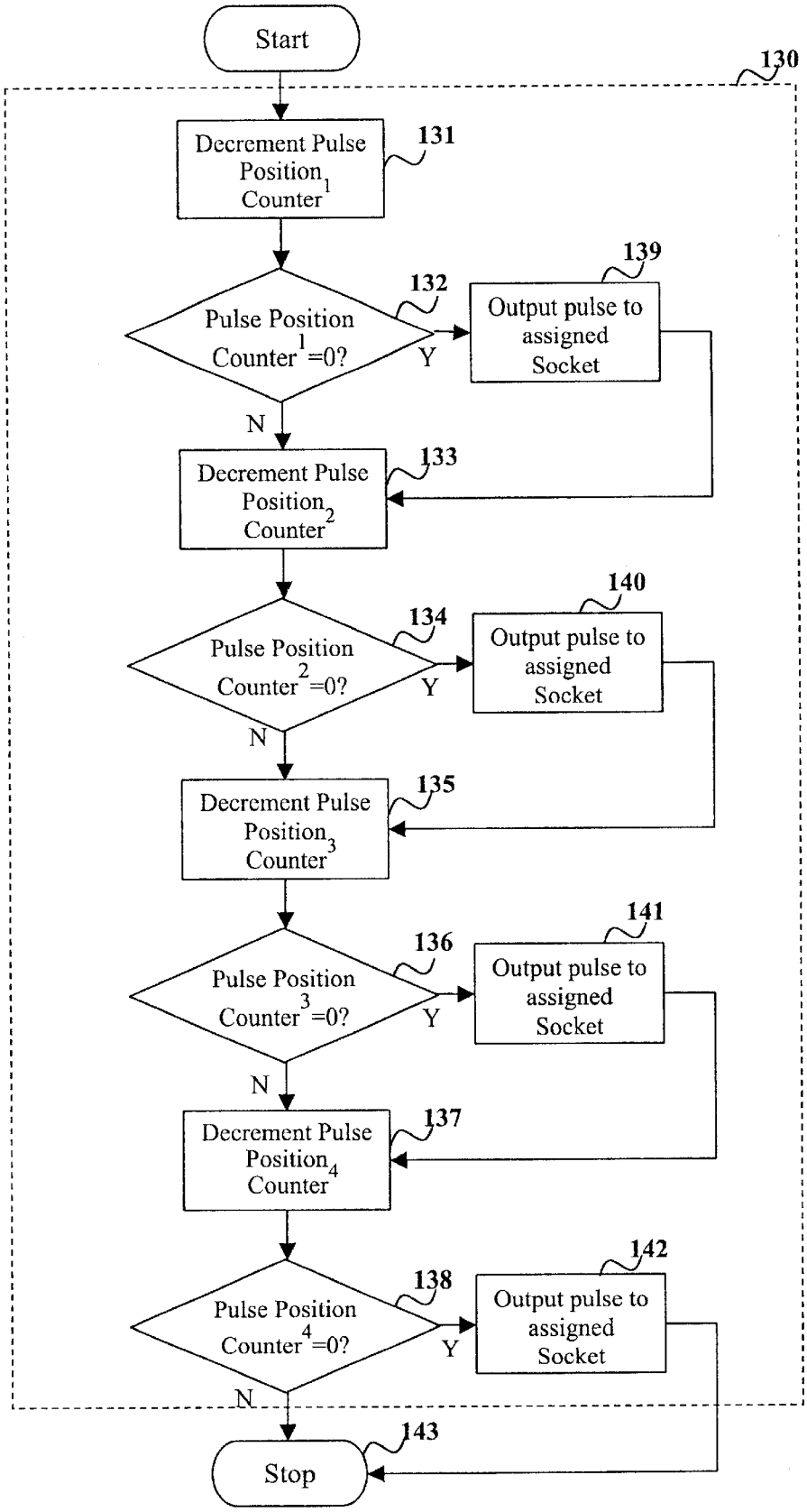
FIG. 9 is a flowchart of an Interrupt Service Routine that generates the pulse signal to energise the TRIACS means.
Figure 10:
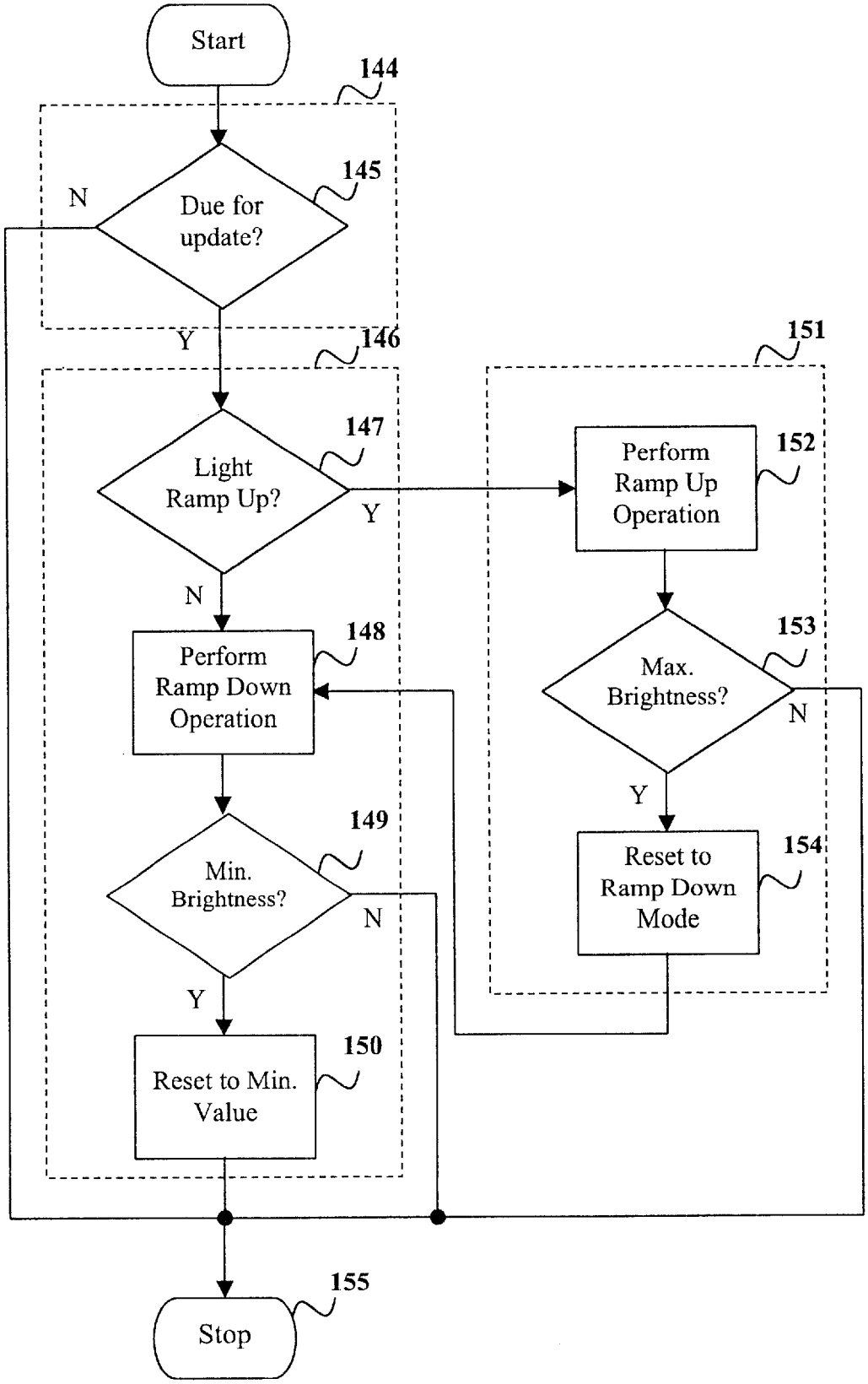
FIG. 10 is a Modulation Subroutine Module flowchart.

Conceptually, the looping process 103 includes various subroutine modules 106 (FIG. 6), 122 (FIG. 8), 130 (FIG. 9), 144, 146 and 151 (FIG. 10). The looping process 103 also includes a subroutine module 116 (FIG. 7), which is an exception since the subroutine module 116 includes four unique processes that share a same source code and is therefore strictly not a subroutine module.

The subroutine module 106 is known as a System Initialisation and Maintenance Module. The purpose of this subroutine module is to set up and maintain operating parameters and variables for subsequent subroutines. The System Initialisation and Maintenance Module is also the subroutine responsible for manipulating the variables so that various effects, the parameters of which are stored in micro-controller U1 memory, may manifest through progressive looping. To elaborate further, the parameters store the amount of changes that need to be added or subtracted from the variables so that the ramping-up or -down effects may be observed. A large parameter value signifies a large amount of change in brightness and a small parameter is observable as a very gradual change in brightness.

After the System Initialisation and Maintenance Module is executed, the subroutine module 116 known as Modulation Subroutine Modules is executed. In the preferred embodiment, four triacs T1 to T4 are used for delivering electricity supply to the power sockets S1 to S4. Therefore, four processes 117, 118, 119, and 120 are executed in the Modulation Subroutine Module regardless of the number of power socket S1 to S4 that are connected to strings of lighted elements.

Figure 7:
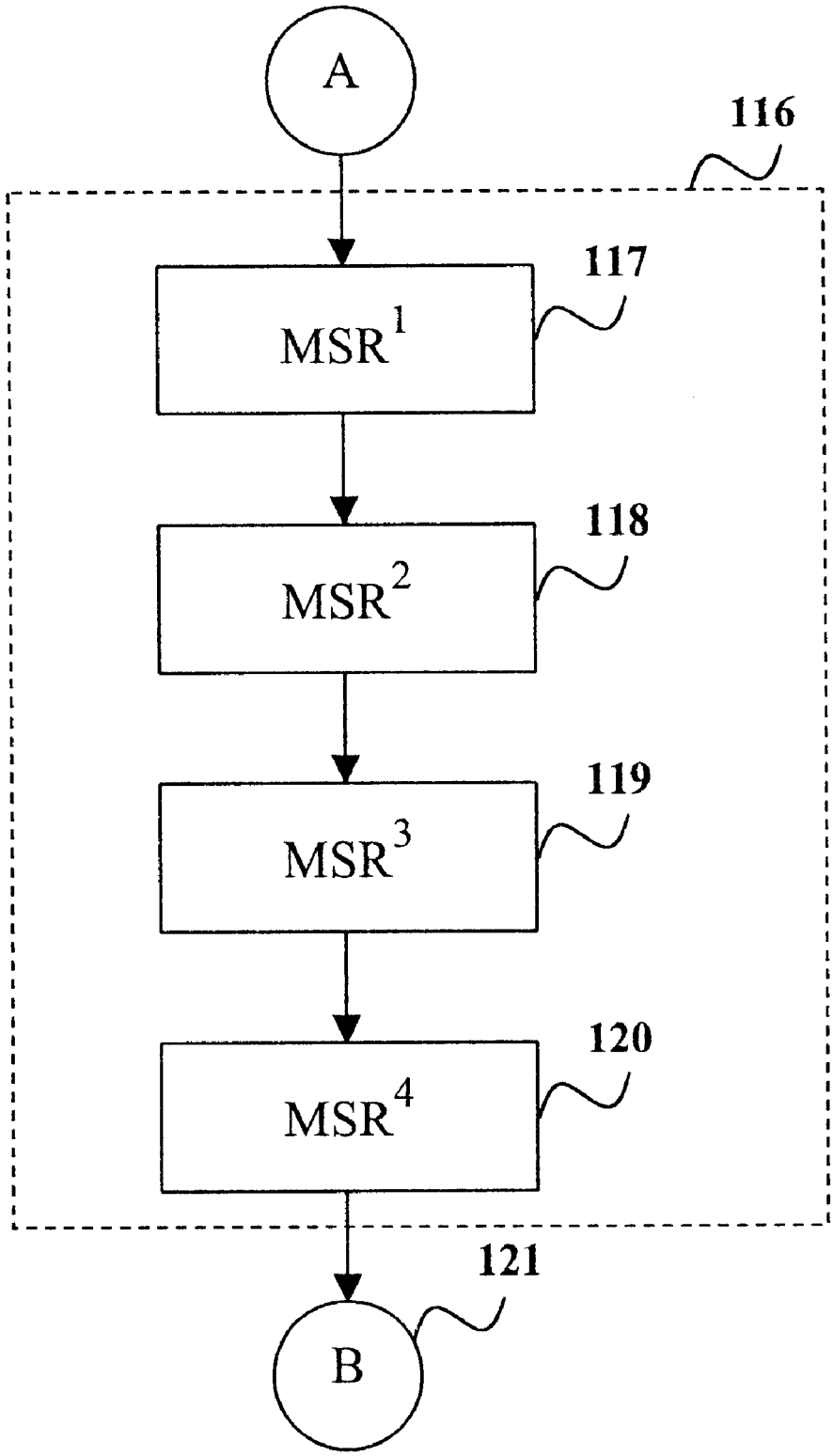
FIG. 7 is a flowchart depicting a macro view of Modulation Subroutine Modules, which includes four Modulation Subroutine Modules.

The Modulation Subroutine Modules basically determine at which point and through which pulse pin PIN9, PIN8, PIN7, or P1N6 to send a pulse signal 1, 2, 3, or 4, respectively, to trigger or fire the corresponding triac T1, T2, T3, or T4. The Modulation Subroutine Modules do not cause the pulse signals 1, 2, 3, and 4 to fire but calculate values known as Pulse Positions for generating the pulse signals 1, 2, 3, and 4 and store the values in variables. The Modulation Subroutine Modules are also synchronised to the zero crossing points 202 so that all other lighting controllers executing the same program may create exactly the same lighting effect. The Modulation Subroutine Module is executed four times for the four power sockets S1 to S4 after which the program waits for the next zero crossing point 202 in an Idle Time Handler Module 122 as shown in FIG. 7. During the wait state and other times when the micro-controller U1 Interrupt Handler is not disabled, an Interrupt signal triggers the micro-controller U1 to execute an Interrupt Service Routine Module 130. In the Interrupt Service Routine Module 130, the variables calculated in the Modulation Subroutine Modules are used to trigger the triacs T1 to T4. Depending on the value of the variable for each process, a corresponding triac T1 , T2, T3, or T4 may receive the pulse signal 1, 2, 3, or 4, respectively, at the appropriate moment so as to generate the correct amount of electricity current for a smooth modulation of light brightness.

Figure 6:
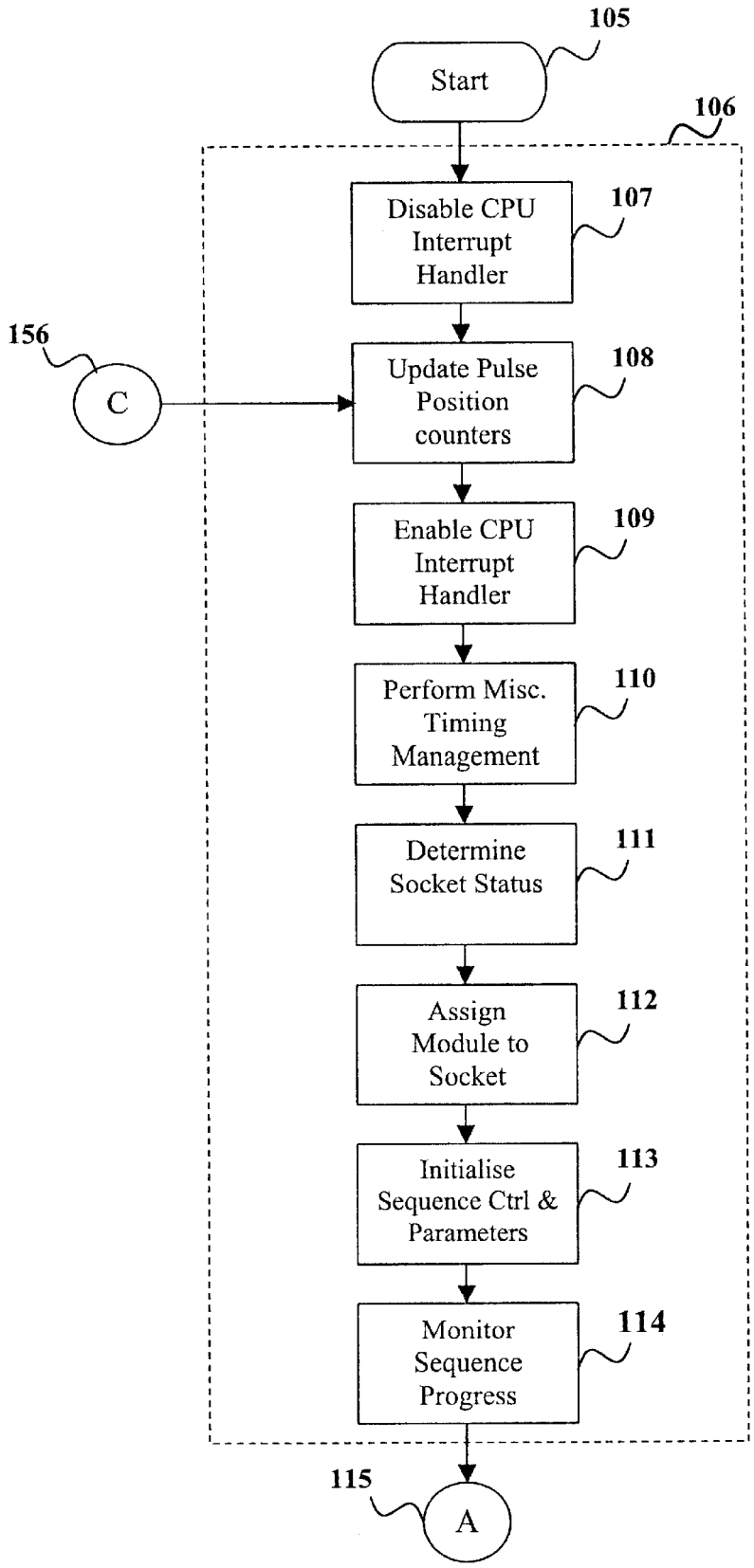
FIG. 6 is a System Initialisation and Maintenance Module flow chart.

With reference to FIG. 6, the System Initialisation and Maintenance Module 106 starts execution in a step 105. The primary function of the System Initialisation and Maintenance Module 106 is to re-initialise the looping process 103 at every zero crossing point 202 with the effect of group-synchronisation in situations where multiple lighting controllers are used, and perform maintenance functions including time delay for pattern sequencing.

A first step 107 during the execution of the System Initialisation and Maintenance Module 106 is the disabling of the micro-controller U1 Interrupt Handler so that no external signals can interrupt the looping process 103 during the crucial phase when maintenance subroutines are executed in the looping process 103.

This is followed by a step 108 to update values known as Pulse Position Counters by copying the Pulse Positions values. The looping process 103 then enables the micro-controller U1 Interrupt Handler in step 109 to allow an internal timer signal to trigger the Interrupt Service Routine Module 130.

The current process continues in a step 110 with performing various Miscellaneous Timing Management Routines to ensure synchronised execution of the various processes.

The current process then checks the status of the power sockets S1 to S4 in step 111 by polling the power sockets S1 to S4 for the square wave signal 6, 7, 8, or 9. If a square wave signal 6, 7, 8, or 9 of the same frequency with the A/C mains is detected, the corresponding power socket S1, S2, S3, or S4 is connected and is marked as active. If a signal bearing a waveform other than a square wave is detected, the corresponding power socket S1, S2, S3, or S4 is not connected, and is marked as inactive. In both cases, a status variable is updated to reflect the appropriate state of the power socket S1, S2, S3, or S4.

The current process continues by dynamically assigning various Modulation Subroutine Modules to different output power sockets S1 to S4 in a step 112. The assignment may be randomly determined or pre-loaded from a special profile. The effect of this is that different strings of lights with different colours exhibit various different patterns of lighting effects at different time.

Once the assignment is completed, the current process initialises a Sequence Control event in a step 113, which controls the pattern generation based on a multitude of effect patterns that are pre-loaded. These effect patterns allow the display of various effects such as fireworks, gentle wave, etc. The Sequence Control event accomplishes the effects patterns by setting certain parameters in the step 113 so that a Monitor Sequence Progress event occurring in a step 114 may handle the actual execution of the effect pattern.

The effects patterns consist of various parameters that are organised in groups of steps. These groups form effects patterns that may be created or modified by a producer. The Monitor Sequence Progress event in the step 114 monitors the groups assigned to the various modules and track the steps that have been executed. When the steps have been executed, a new group of effects patterns is assigned to another module for execution. Once that is complete, the looping process 103 exits the System Initialisation and Maintenance Module in a step 115 and proceeds to the Modulation Subroutine Modules 116 (MSRs).

With reference to a macro view flowchart in FIG. 7, the Modulation Subroutine Modules 116 are described in greater detail to illustrate the relationship between the different processes designated $MSR^1$ 117 through $MSR^4$ 120. The processes $MSR^1$ 117 through $MSR^4$ 120 essentially rely on execution of the same source code, the only difference being the parameters loaded into each Modulation Subroutine Module. As illustrated in FIG. 7, the different processes are executed in sequence 117, 118, 119, 120, before the looping process 103 proceeds in a step 121 to the Idle Time Handler Module 122.

Figure 8:
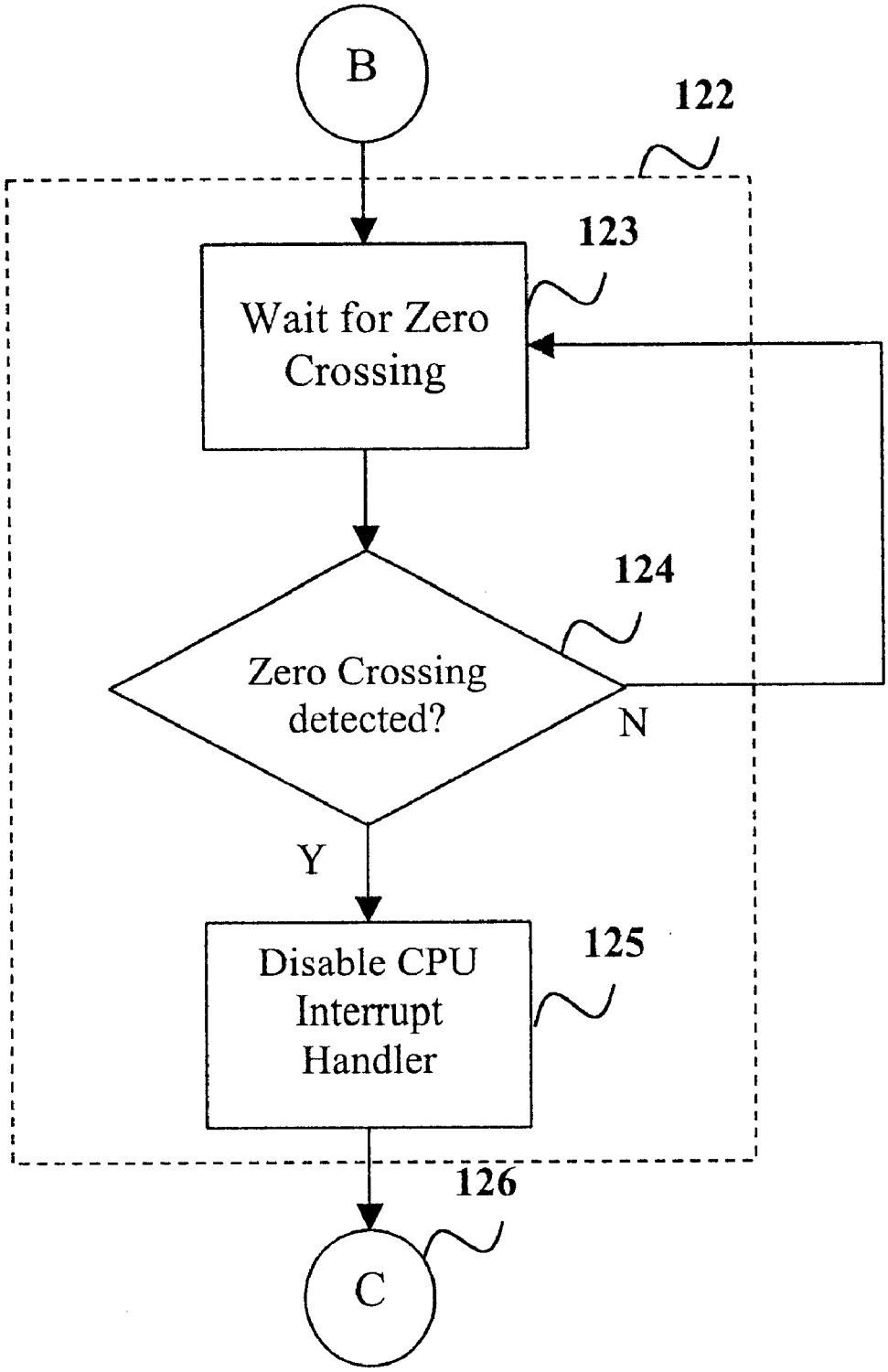
FIG. 8 is an Idle Time Handler Module flowchart.

With reference to FIG. 8, the looping process 103 enters the Idle Time Handler Module 122 in the step 121. Since the micro-controller operates at a much faster rate than half an A/C cycle, a long period of idle time passes during a wait event in a step 123 before the next zero crossing point 202 is reached. The current process checks for a zero crossing point 202 in a step 124. If a zero crossing point 202 detected, the micro-controller Interrupt Handler is disabled in a step 125 so the current process exits in a step 126 and returns in a step 156 to update the next Pulse Position Counters in the step 108. Otherwise, the current process loops back to the step 123.

With reference to FIG. 9, the operation of the Interrupt Service Routine Module 130, hereinafter referred to generally as ISR 130, is described. The ISR 130 is a special subroutine module because the ISR 130 may be executed at any time regardless of at which point the program is executing, except when the microcontroller U1 Interrupt Handler is disabled. When ISR 130 is executed, the program is halted and program states including registers and stacks pointers are saved. The micro-controller U1 then loads the ISR 130 and begins execution.

The ISR 130 is used when a critical real-time function needs to be executed without delay, such as the generation of a pulse signal 1, 2, 3, or 4 to fire a triac T1, T2, T3, or T4.

After the program is halted, the ISR 130 first decrements a Pulse Position Counter associated with the $MSR^1$ 117 in a step 131 and checks if the Pulse Position Counter is equal to zero in a step 132. If the Pulse Position Counter is zero, a pulse signal 1, 2, 3, or 4 in a step 139 is sent to trigger the triac T1 , T2, T3, or T4 of the assigned power socket S1, S2, S3, or S4. The pre-determined information is store in an Output Socket Index. After firing, the current process continues by decrementing the Pulse Position Counter of the next Modulation Subroutine Module. If a Pulse Position Counter of the $MSR^1$ 117 is not zero in the step 132, the Pulse Position Counter of the next Modulation Subroutine Module is also decremented. This process is continued for all three remaining Modulation Subroutine Modules. Hence, the ISR 130 goes though a similar sequence of Pulse Position Counter decrement in a step 133, zero checking in a step 134 and triac firing in a step 140 in relation to the next Modulation Subroutine Module. The ISR 130 undergoes another similar sequence of steps 135, 136, 141 for the next Modulation Subroutine Module, and a further similar sequence of steps 137, 138, 142 for the last Modulation Subroutine Module. Following which, the current process exits in a step 143 and the micro-controller U1 restores the previous program state and continue running from that point onwards.

With reference to FIG. 10, the looping process 103 enters the Modulation Subroutine Module in a process 144, the main purpose of which is to calculate the value for the firing of a pulse signal 1, 2, 3, or 4 that triggers a triac T1 , T2, T3, or T4. The calculated value is called Pulse Position. Since the Modulation Subroutine Module is executed at every zero crossing point of each A/C cycle, the Pulse Position value may be updated on every execution. This is, however, subject to a Ramp Rate value, which is a preloaded parameter used in the current process. If the Ramp Rate value is '1', the updating is done on every execution. If the Ramp Rate value is 'N', then out of every N executions, only one update is done.

The current process in the step 145 checks if the Pulse Position value is due for update. If not, the current process exits in a step 155. If update is due, the looping process 103 enters a process 146 and checks from a Ramp Value, which is a parameter used in the current process, whether the channel is on a ramp up cycle or ramp down cycle in a step 147.

When the current process detects that the channel is on a ramp up cycle, the looping process 103 enters a process 151 and performs ramp up operation in a step 152 by reducing the Pulse Position value by an amount specified in the Ramp Value. The current process then checks the Pulse Position value for the maximum brightness value in a step 153. If maximum brightness is not reached, the current process exits in the step 155. If maximum brightness is reached, the channel is reset to ramp down cycle in a step 154 and the looping process 103 returns to a step 148 to perform ramp down operations.

When the current process detects that the Modulation Subroutine Module is on a ramp down cycle in the step 147, the current process performs the ramp down operations in the step 148 by increasing the Pulse Position by the amount specified in the Ramp Value. The current process then checks the Pulse Position value for the minimum brightness value. If minimum brightness is not reached, the current process exits in the step 155. If minimum brightness is reached or surpassed, the Pulse Position value is reset to the minimum value in a step 150 to prevent an overflow condition and the current process exits in the step 155.

In the foregoing manner, a lighting controller is described according to embodiments of the invention for providing a wide variety of lighting displays characterised by synchronous and continuous modulated brightness of strings of lighting elements. Although only a number of embodiments are disclosed, it will be apparent to one skilled in the art in view of this disclosure that numerous changes and/or modifications can be made without departing from the scope and spirit of the invention.

What is claimed is:

1. A lighting controller for performing lighting control operations of decorative lighting elements, comprising a processor;

an electricity supply connector to which a lighting element is connectable;

a switching device for delivering electricity supply to a lighting element connected to the electricity supply connector wherein the processor calculates the timing and duration for modulating the lighting element brightness and accordingly actuates the switching device to deliver electricity supply to the lighting element.

2. The controller of claim 1, wherein the operations of the processor is dependent on an A/C electricity supply to which the processor is connected.

3. The controller of claim 2, wherein the processor operations are dependent on the frequency of the A/C electricity supply.

4. The controller of claim 3, wherein the processor operations are dependent on zero crossing points of the A/C electricity supply.

5. The controller of claim 4, wherein the processor actuates the switching device by sending a trigger signal to the switching device.

6. The controller of claim 5, wherein the processor sends the trigger signal to the switching device after a zero crossing point passes to close the switching device and the switching device opens at a subsequent zero crossing point.

7. The controller of claim 6, wherein the switching device is a triac having a gate to which the trigger signal is sent.

8. The controller of claim 1, wherein the processor determines whether a lighting element is connected to the electricity supply connector.

9. The controller of claim 8, wherein the processor is connected to the electricity supply connector for determining whether a lighting element is connected to the electricity supply connector.

10. The controller of claim 9, wherein the processor is connected to the electricity supply for comparison with the electricity supply connector in determining whether electricity supply is present at the electricity supply connector, whereby the presence of electricity supply at the electricity supply connector is indicative that a lighting element is connected to the electricity supply connector.

* * * * *